United States Patent [19]

Scott, Jr.

[11] Patent Number: 4,655,235

[45] Date of Patent: Apr. 7, 1987

[54] CHEMICAL CONTAMINATION MONITOR

[76] Inventor: Ralph A. Scott, Jr., 2819 Elsmore St., Fairfax, Va. 22031

[21] Appl. No.: 661,986

[22] Filed: Oct. 18, 1984

[51] Int. Cl.[4] ..... B08B 3/02; B08B 5/02; B08B 13/00

[52] U.S. Cl. ..... 134/99; 128/1 R; 134/113; 134/199; 134/200; 422/119; 73/865.6

[58] Field of Search ..... 134/95, 99, 113, 166 R, 134/170, 171, 199, 200; 68/13 R, 20, 205 R; 252/626; 128/1 R, 1 B; 34/89; 15/302; 422/62, 119; 73/432 SD, 432 R

[56] References Cited

U.S. PATENT DOCUMENTS

| | | | |
|---|---|---|---|
| 2,989,965 | 6/1961 | Rod | 134/113 X |
| 3,475,965 | 11/1969 | Kobbin et al. | 73/432 R |
| 3,501,213 | 3/1970 | Trexler | 128/1 R |
| 4,111,034 | 9/1978 | Hubner | 68/13 R X |
| 4,202,676 | 5/1980 | Pelosi, Jr. et al. | 128/1 R X |
| 4,304,224 | 12/1981 | Fortney | 128/1 R |

*Primary Examiner*—Philip R. Coe

*Attorney, Agent, or Firm*—John H. Raubitschek; Arthur I. Spechler; Werten F. W. Bellamy

[57] ABSTRACT

A chemical contamination monitoring system is provided for monitoring and decontaminating protective clothing that has been exposed to toxic chemicals. The system includes a decontamination chamber in which the clothing is supported and a spray assembly, including a plurality of suitably directed spray nozzles, for spraying the clothing with a wash-solvent. Hot air is directed over the clothing to volitalize the contaminates and, after passing over the clothing, the hot air is withdrawn for analysis using gas chromatography or other known techniques. The used solvent can also be analyzed.

11 Claims, 13 Drawing Figures

CHEMICAL CONTAMINATION MONITOR

FIELD OF THE INVENTION

The present invention relates to a contamination monitor and, more particularly, to a monitoring system for monitoring the contamination of protective clothing worn in toxic chemical environments and for decontaminating that clothing.

BACKGROUND OF THE INVENTION

Protective clothing is worn during many toxic chemical operations. Then protective clothing is removed after the worker exits from the work area and currently this clothing is not tested for toxic chemical contamination unless the worker knows that the clothing has been in contact with a toxic chemical. Under present practice, if the worker judges that the clothing is not contaminated, the used clothing is transported, stored, laundered and reused in new operations without any testing for contamintion. Obviously there is a substantial risk of exposure to toxic chemicals with such procedures and the health hazard involved could be considerable in some circumstances.

A number of prior art patents disclose sterilization devices and systems of various kinds including, for example, the following: U.S. Pat. Nos. 2,715,251 (Vischer et al); 3,895,911 (Prins); 4,170,421 (Balding et al); and 4,192,845 (Kalasek). Another patent of possible interest is U.S. Pat. No. 3,007,178 (Altman et al) relating to a combination bath and shower. As will become apparent none of these patents teaches or suggests the present invention.

SUMMARY OF THE INVENTION

In accordance with the invention, a chemical decontamination monitoring system is provided which comprises:

a decontamination chamber; means for supporting protective clothing suspected of contamination within the chamber; decontamination solvent spray means for spraying a decontamination solvent onto the protective clothing supported within the chamber; means for directing air over the protective clothing; means for withdrawing the air from the chamber after the air has passed over the protective clothing; and means for analyzing the air withdrawn from the chamber so as to determine the contaminate content thereof, thereby enabling the spraying process to be controlled so as to ensure that all contaminates are removed.

Preferably, the system also comprises means for withdrawing the used solvent from the chamber and means for monitoring the solvent so withdrawn from the chamber to determine the contaminate content.

The decontamination solvent spray means preferably comprises a plurality of spray nozzles, a reservoir for solvent located at the top of the chamber and a recirculation pump for pumping used solvent at the bottom of the chamber up to the reservoir.

Advantageously, the spray nozzles are equally spaced around the chamber at upper, intermediate and lower locations. Further, the floor of the chamber is preferably shaped to provide drainage thereof and the means for withdrawing the solvent advantageously includes valve means located in an outlet line connected to the bottom of the chamber.

The chamber preferably includes a pneumatically sealed door for providing access to the chamber. More particularly, the chamber advantageously includes a door opening and the door provided extends a substantial extent beyond the door opening around the entire periphery thereof, with at least one seal being produced on the door and on the adjacent chamber wall to provide a chamber.

The air movement was a fan to move heat conditioned air. Advantageously, the air system includes an outside air inlet. Filters over the air inlet insure toxic effluents within the monitor chamber do not egress into the external atmosphere.

Preferably, the clothing supporting means comprises means for supporting a protective suit, outer gloves and outer boots. The suit is preferably inflated prior to being supported by the supporting means to provide maximum exposure, and the suit supporting means in one embodiment comprises a pair of elongate supports adapted to fit under the armpits of the inflated suit. In another embodiment the suit supporting means comprises suit support means suspended from the ceiling of the chamber. In one arrangement, the suit support means includes a pair of hooks. In another, the suit support means comprises fasteners for connection to the suit. In yet another arrangement, the suit support means comprises loops for encircling the arms of the suit. In accordance with a further preferred embodiment, the glove and boot supporting means include air inlets for filling with air the gloves and boots supported thereby. The boot supporting means each preferably includes a support clip for supporting a portion of the boot.

In a preferred embodiment, the air analyzing means comprises gas chromatographic means. Further, the air analyzing means preferably includes two paths or branches with one of the paths including a fluid collection reservoir. In addition, the used solvent analyzing means also preferably comprises liquid chromatographic means.

Other features and advantages of the invention will be set forth in, or apparent from, the detailed description of the preferred embodiments which follows.

DESCRIPTION OF THE PREFERRED EMBODIMENTS

Figure 1:
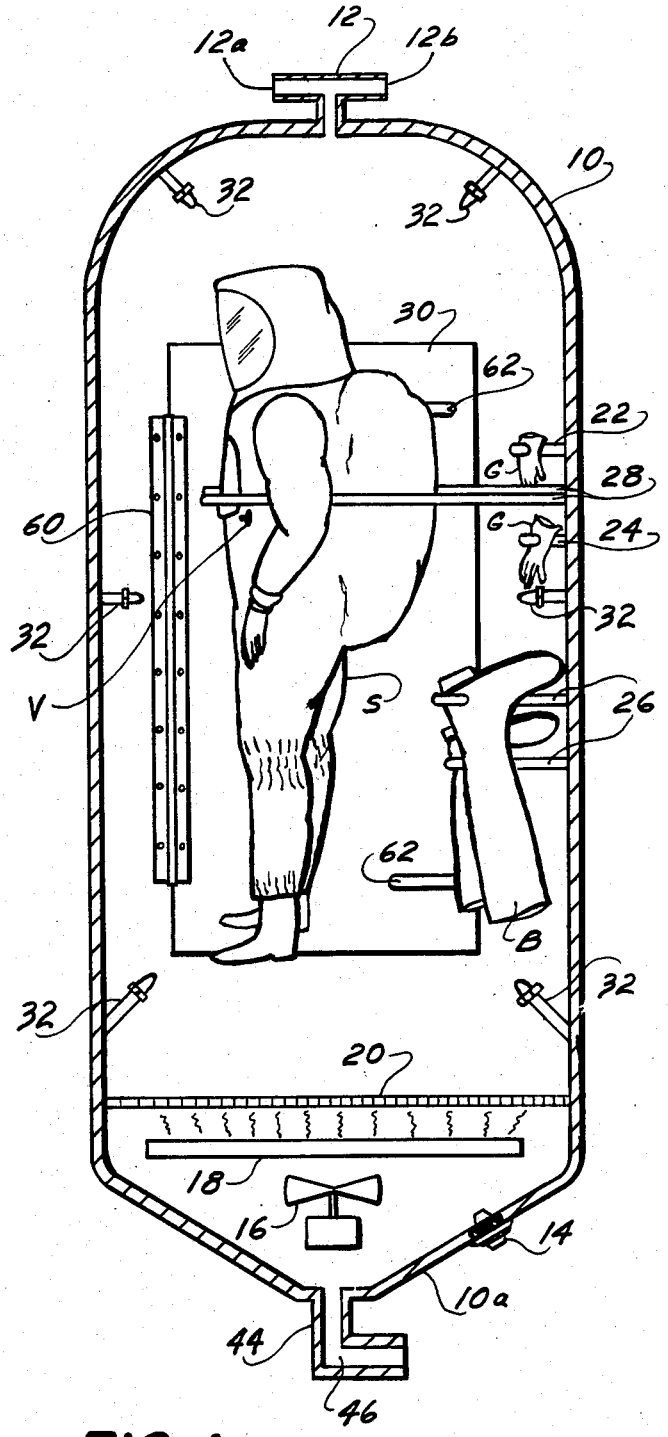
FIG. 1 is a schematic cross section of the decontamination chamber of a contamination monitor constructed in accordance with one preferred embodiment of the invention.

Referring to FIG. 1, a preferred embodiment of the decontamination chamber of the chemical contamination monitor of the invention is shown. The chamber, which is generally denoted 10, is basically cylindrical in shape and includes a conical base portion 10*a* for a drainage. The chamber 10 includes an air outlet 12 at the upper end thereof which is divided into two outlets 12*a* and 12*b* so that the outlet air is caused to flow along paths A and B for separate processing as discussed below.

A filtered air inlet 14 is provided at the bottom of chamber 10 and a fan 16 is used in circulating the air. A circular heater 18 is disposed above fan 16 for heating the inlet air. Heater 18 is located below an open mesh steel floor 20 which permits drainage of the solvent-wash described hereinbelow.

A series of supports are provided within chamber 10 including upper and lower glove supports 22 and 24 for supporting the outer gloves G of the protective clothing, a support assembly 26 for the outside boots B and a support assembly 28 for the air pressurized suit S. These supports are described in more detail below. The protective suit is supplied with an inlet valve V which provides for inflation of the suit thereby exposing the maximum surface area of the suit for treatment.

Access to chamber 10 is provided through a pneumatically sealed door 30 which is also described in more detail below.

Figure 2:
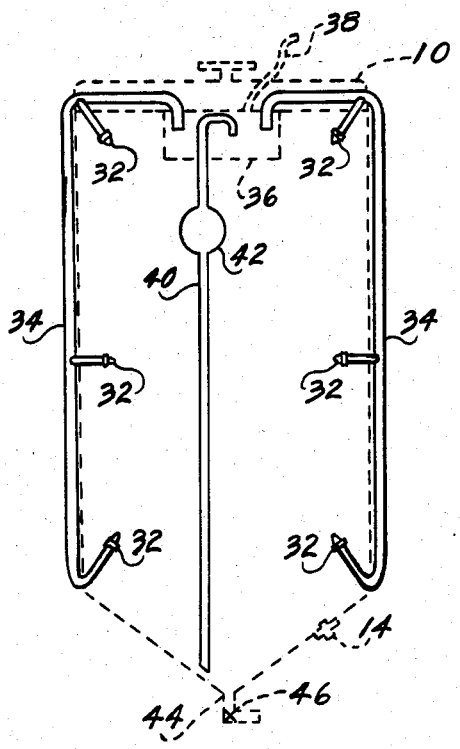
FIG. 2 is a schematic cross section of the chamber of FIG. 1 showing the solvent spray system.

A series of recirculating solvent wash spray heads 32 are provided at the top of chamber 10, at an intermediate level and at the bottom. While these spray heads 32 are indicated in FIG. 1, the overall solvent spray system is shown in FIG. 2. As illustrated in FIG. 2, the spray heads 32 are connected by suitable piping 34 to a solvent reservoir 36 mounted at the top of chamber 10. A solvent fill tube or hose 38, with a sealed cap, enables fresh solvent to be supplied to reservoir 36. A solvent return pipe 40 extends from a point near the bottom of chamber 10 into reservoir 36 and a solvent pump 42 connected in pipe 40 enables the used solvent to be pumped up to reservoir 36 to provide recirculation of the solvent. An outlet or exit line 44, including a valve indicated schematically at 46, is located at the bottom of chamber 10 and the combination permits controlled drainage of the chamber.

Figure 3:
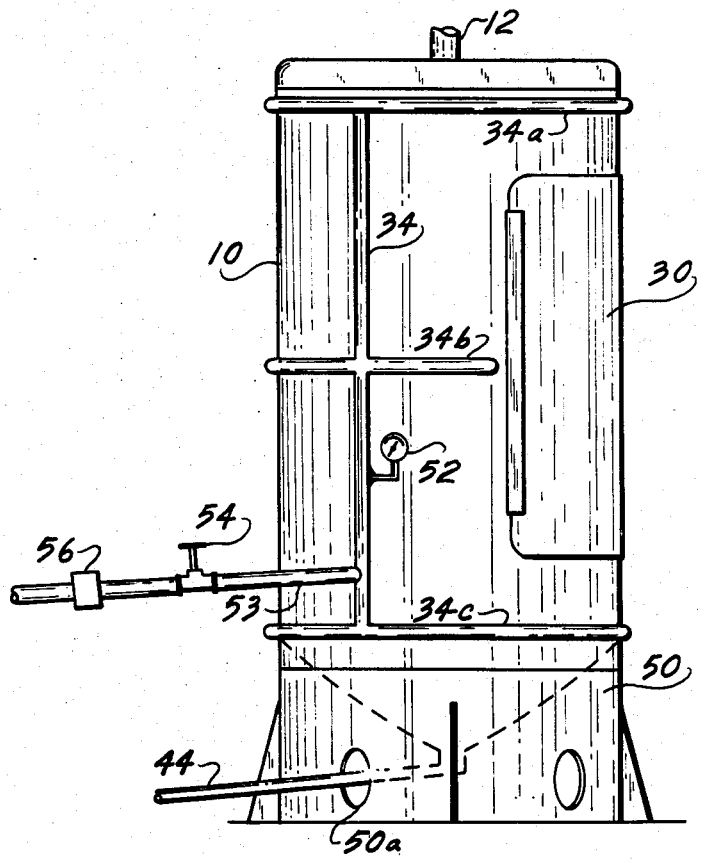
FIG. 3 is a side elevational view of the chamber of FIG. 1 showing the exterior of the chamber.

The piping 34 is also illustrated in FIG. 3, which shows the external appearance of the chamber including a supporting skirt 50 which chamber 10 rests. In a specific, presently preferred embodiment, an upper ring 34*a* of piping 34 is connected to four upper spray nozzle tips 32, which are equally spaced and, as shown in FIGS. 1 and 2, are downwardly inclined so as to spray in a downwardly inclined direction. A central ring 34*b* is connected to three equally spaced, immediately disposed nozzle tips 32 which are disposed to spray horizontally while a lower ring 34*c* is connected to four equally spaced, lower nozzle tips 32 which are disposed to spray in an upwardly inclined direction. The piping 34 includes a pressure gauge 52 and a connection located adjacent to lower ring 34*c* includes a gate valve 54 and a strainer 56. The drain outlet line 44 referred to above extends through an opening 50*a* in support skirt 50, as illustrated.

Figure 4:
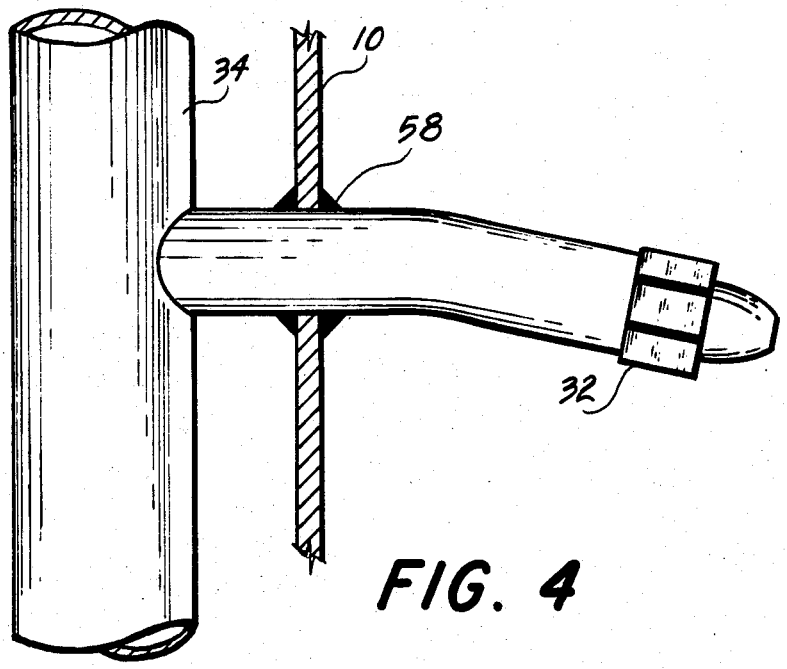
FIG. 4 is a detail, partially in cross section, of one of the spray heads of FIGS. 1 and 2.

Referring to FIG. 4, a detail of one of the nozzles 32 is shown. The nozzle 32 is welded to the wall of chamber 10 by welds indicated at 58 and the nozzles themselves preferably comprise tungsten carbide, wide angle, high pressure spray tips which provide a full cone pattern at a spraying capacity of 1.5 Gpm minimum.

Figure 5:
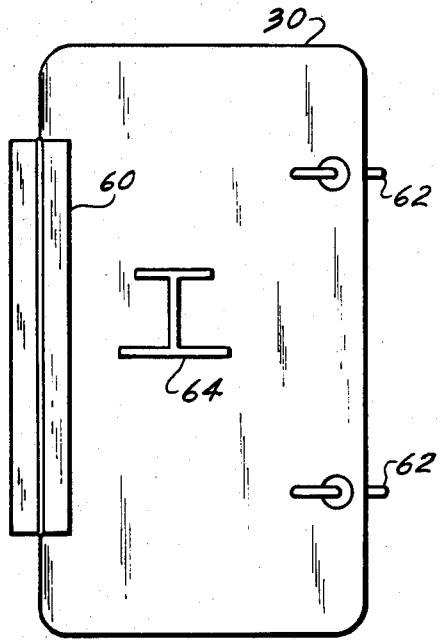
FIG. 5 is a side elevational view of one embodiment of the door of the chamber of FIG. 5.
Figure 6:
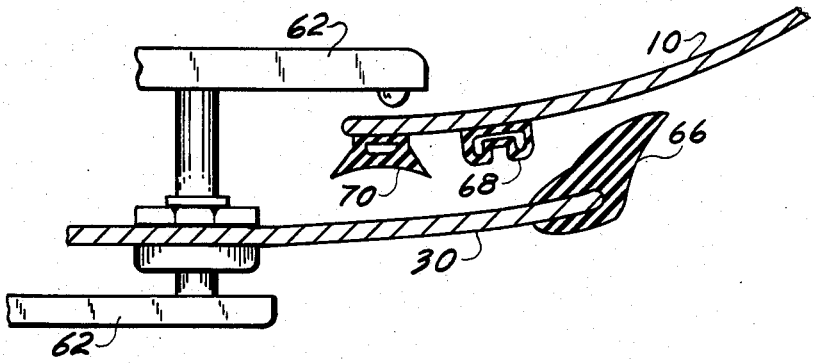
FIG. 6 is a detail, partially in cross section, of the door of FIG. 5.

Referring to FIGS. 5 and 6, details of the construction of door 30 are shown. As shown in FIG. 5 (and FIG. 1) door 30 is preferably mounted within the door opening in chamber 10 by means of a piano hinge 60 and includes upper and lower door locks 62. In addition, air outlet lines are preferably provided, as indicated at 64, which, as explained below, are used in supporting the outer gloves and boots as discussed in more detail below. As shown in FIG. 6, the door 30 is pneumatically sealed by means of a series of soft pliable rubber seals indicated at 66 (attached to door 30) and at 68 and 70 (attached to the chamber of wall 10). The door 30 is preferably constructed to overlap the complete circumference of the door opening in frame 10 by a substantial amount, typically bout four inches in a specific embodiment.

Figure 8:
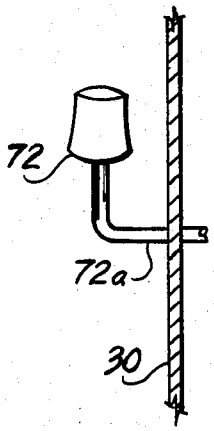
FIG. 8 is a detail, partially in cross section, of one of the supports of FIG. 7.
Figure 7:
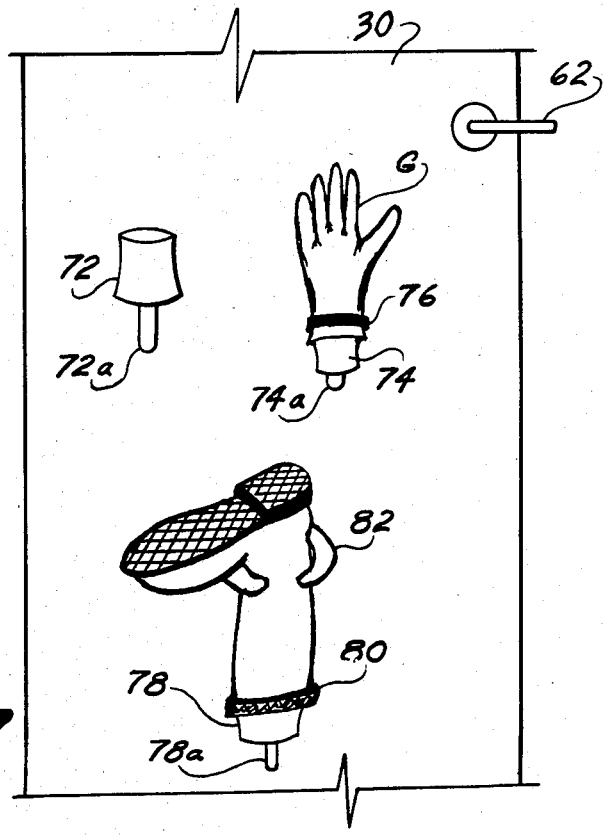
FIG. 7 is a plan view of a further embodiment of a chamber door showing a boot and glove support arrangement.

As set forth above, supports are provided in chamber 10 for the clothing to be tested for chemical contamination. These may take a number of different forms and a number of different embodiments will be described. One embodiment is schematically illustrated in FIG. 1 and as explained in more detail below, basically comprises elongate support members to which the gloves and boots are clipped or otherwise attached. A further embodiment is illustrated in FIGS. 7 and 8. As shown, shaped sleeves 72 and 74 are provided on which a glove, indicated at G, can be mounted. The sleeves 72 and 74 are connected to respective air lines 72*a* and 74*a* so that the gloves G can be inflated to provide exposure of the maximum surface area. A rubber band 76 or the like can be used in holding the glove G in place. As shown in FIG. 8, the air lines 72*a*, 74*a*, which generally correspond to air lines 64 of FIG. 5, can be formed by stainless steel tubing which extends through door 30 and is welded thereto. Similar sleeve supports are provided for the outer boots, one of which supports, denoted 78, is shown in FIG. 7. Sleeve support 78 is of an elongate pipe-like configuration and is connected to an associated air line 78*a*. A rubber band 80 is used to hold the boot B in place on sleeve 78, while a generally U-shaped stainless steel wire boot support or clip 82 is used to support the top half of boot B.

Figure 9:
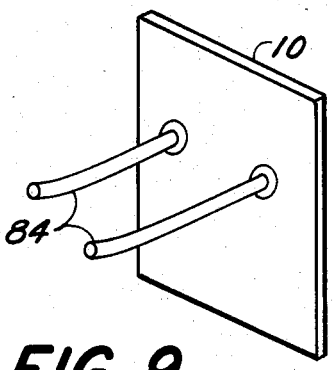
FIGS. 9, 10, 11 and 12 show different embodiments of the protective suit support arrangement of the invention.

A number of different support arrangements for the suits can also be provided. Referring to FIG. 9, a pair of supports 84 are shown which are similar to the supports 28 of FIG. 1 but which are curved at the ends to provide better engagement.

Figure 10:
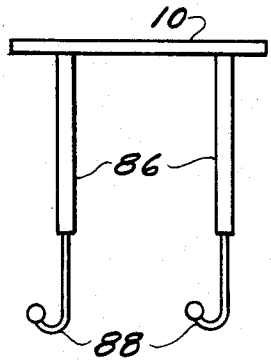

A futher embodiment is illustrated in FIG. 10, wherein a pair of tubes 86 are hung from the ceiling of chamber 10, and curved members 88, fabricated of heavy wire with a rubber tip, are affixed to the tubing 86, for supporting the arms of the suit.

Figure 11:
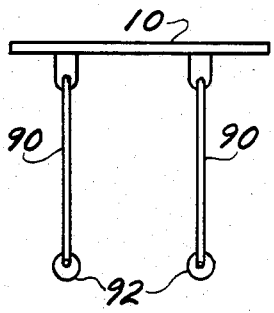

In yet another embodiment illustrated in FIG. 11, wire hooks 90 are affixed to the ceiling of chamber 10 and attached to eyelets 92 which are fastened to the suit.

Figure 12:
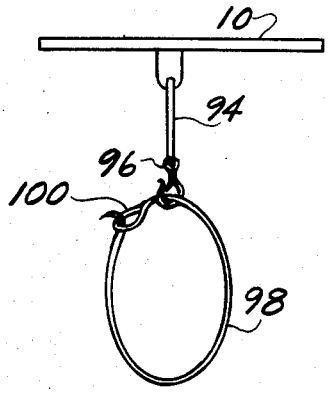

In a further embodiment illustrated in FIG. 12, wire hooks 94 are affixed to the ceiling of chamber 10 and a snap clamp 96 is provided which is connected to a generally circular section or loop of wire, denoted 98, which wraps around the shoulder of the suit and is hooked through a further loop 100.

Figure 13:
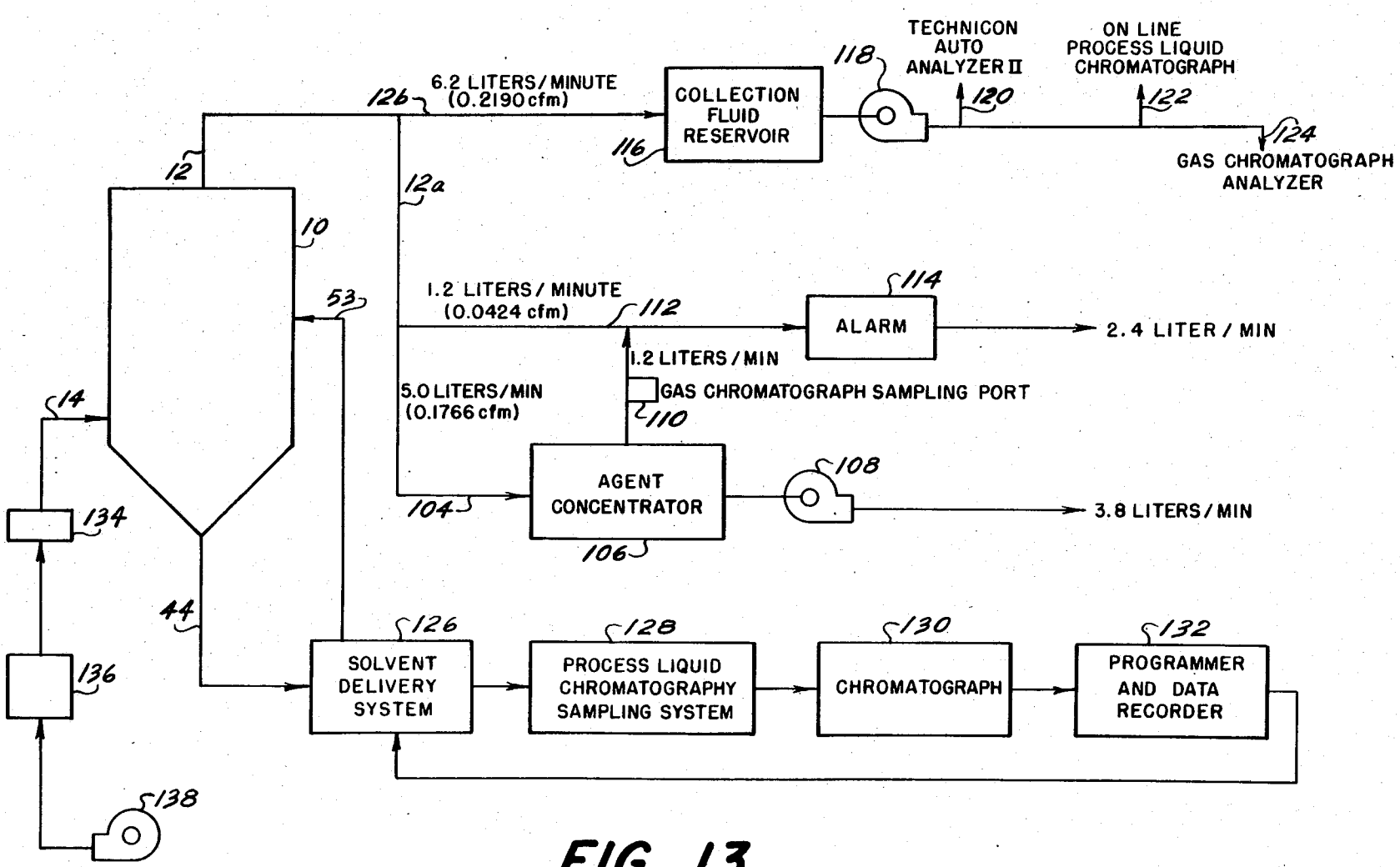
FIG. 13 is a block diagram of the overall system including the analyzing and control units.

Referring to FIG. 13, a schematic diagram is provided of the overall system. As illustrated, the air flow outlet paths 12*a* and 12*b* are separately processed with outlet 12*a* being connected through line 104 to a chemical concentrator 106 which is, in turn, connected to an auxiliary air vacuum pump 108 and to a gas chromatograph sampling port 110 or septum. The latter is connected to a branch line 112 from outlet 12*a* and ultimately to an alarm unit 114. Typical flow rates at various points in the system are indicated in the drawing.

Outlet 12*b* is connected to a collection fluid reservoir 116 and the fluid therein is pumped by a main vacuum pump 118 to outlets 120, 122 and 124 which, as illustrated, are respectively connected to a Technicon automatic analyzer (not shown), an on-line process liquid chromatograph (not shown) and a gas chromatograph analyzer unit (not shown).

The solvent inlet line 53 and outlet line 44 are connected to the solvent delivery system, indicated at 126, an output of which, containing process liquid, is connected to a high performance process liquid chromatographic sampling system 128 and thence to a chromatograph 130 and a programmer and data recorder 132.

The air inlet 14 of chamber 10 is connected to a hot air supply system comprising a filter 134, a heat exchanger 136 and an air fan 138.

Briefly considering the operation of the decontamination system of the invention, in order to provide the maximum exposed surface area, the suit S, after removal, should be air inflated as discussed above using the inlet valve V. The pneumatically sealable door 30 is then opened and the protective clothing, i.e., suit S, gloves G and boots B, are placed on their respective supports or holders as described above. The door 30 is then closed and the pneumatic seal provided for door 30 is established and tested for impermeability. The heater 18 is set for the temperature that will assure that the chemical contaminates on the clothing will be volatilized from the clothing surfaces into the air stream. As discussed above, this air stream is created by fan 16 which assists in providing circulation of air. The preselected temperature within the chamber 10 is controlled by a theromostat (not shown). The intake air for inlet 14 passes through filter 134 as described above which prevents any exchange of toxic chemicals between the inside of chamber 10 and the outside environment. Air flow out of the chamber through outlets 12*a* and 12*b* is maintained by vacuum pumps 118 and 108 which are an integral part of the analytical instrumentation systems shown in FIG. 13.

The protective clothing should be retained within chamber 10 for sufficiently long period of time to assure that any chemical present on the protective clothing surfaces will be volatilized. The air outlets 12*a* and 12*b* are also equipped with a control valve (not shown) and an air flow regulator-gage (not shown) used in controlling the air flow rates. The concentrator 106 splits the air stream into two paths. One path selectively removes minute quantities of the toxic chemical which is absored and held onto resins for a selected period of time. At the end of the time period, the toxic chemical is eluted from the resin and directed through the chromatographic detection system 110 and alarm 114. By this means minute quantities of chemical are detected which would not be detected directly. The second air path processes any toxic chemical vapor directly through the chromatographic detection 110 and alarm 114 system.

Further, both of the exit air streams from outlets 12*a* and 12*b* in the instrumentation system use chemical filters (not shown). The air from line B is bubbled through a collection fluid in collection reservoir 116 and is then analyzed using standard analytical chemical procedures as outlined above.

The pressurized solvent-wash spray heads 32 described above use a solvent-wash which is selected for the particular chemicals being used and is placed into the unit using the reservoir 36 mounted at the top of chamber 10. The reservoir is closed using the cap seal associated with inlet line 38 as described above. The solvent-wash is recirculated using pump 42.

Clothing determined to be contaminated by analysis of the air from outlets 12*a* and 12*b* can be detoxified remotely using this system, with the air tests being performed as required until the protective clothing is free of chemical contamination. The solvent-wash chemical system can also be used to wash the clothing prior to reissue. The solvent-wash effluent at outlet 44 can also be analyzed for chemical contamination of interest using the high performance liquid chomatographic analysis system formed by units 128 and 130 or using other standard analytical procedures. Any detected chemical contaminate is retained and detoxified prior to release.

Although it is contemplated that a worker would remove the protective clothing prior to monitoring in the system as described above, this is not necessary and a futher unique feature of the invention is that, for many chemicals, a worker can be monitored while wearing a self contained respirator or an outside air supplied respirator without removing the protective clothing by simply stepping into the monitor during the testing and/or decontamination procedures. The temperatures required for these procedures would be one determining factor in deciding whether entry by a worker would be safe.

Although the invention has been described with respect to exemplary preferred embodiments, it will be understood that the invention is not limited to these embodiments and that various modifications may be made therein without departing from the scope and spirit of the invention.

I claim:

1. A chemical decontamination monitoring system comprising:
   - a decontamination chamber;
   - a means for supporting protective clothing suspected of contamination within said chamber;
   - decontamination solvent spray means for spraying a decontamination solvent onto the protective clothing supported within said chamber;
   - means for recirculating solvent spray through said decontamination chamber;
   - means for withdrawing used solvent from the chamber;
   - means for analyzing the withdrawn used solvent to determine the contaminate content thereof;
   - means for directing air over the protective clothing;
   - means for withdrawing the air from the chamber after the air has passed over the protective clothing; and
   - means for analyzing the air withdrawn from said chamber to determine the contaminate content thereof.

2. A chemical decontamination monitoring system comprising:
   - a decontamination chamber;
   - means for supporting protective clothing suspected of contamination within said chamber;

said clothing supporting means including means for supporting a protective suit, outer gloves, and outer boots, wherein said suit is infated prior to being supported by said supporting means, and said suit supporting means comprises a pair of elongate supports adapted to fit under the armpits of the inflated suit;

decontamination solvent spray means for spraying a decontamination solvent onto protective clothing supported within said chamber;

means for directing air over said protective clothing;

means for withdrawing the air from the chamber after the air has passed over said protective clothing; and means for analyzing the air withdrawn from said chamber to determine the .contaminate content thereof.

3. A chemical decontamination monitoring system comprising:

a decontamination chamber;

means for supporting protecting cloth suspected of contamination within said chamber;

said clothing supporting means including means for supporting a protective suit, outer gloves, and outer boots, wherein said supporting means comprises suit support means suspended from the ceiling of the chamber;

decontamination solvent spray means for spraying a decontamination solvent onto protective clothing supported within said chamber;

means for directing air over said protective clothing;

means for withdrawing the air from the chamber after the air has passed over said protective clothing; and means for analyzing the air withdrawn from said chamber to determine the contaminate content thereof.

4. A system as claimed in claim 3 wherein said suit support means includes a pair of hooks.

5. A system as claimed in claim 3 wherein said suit support means comprises fasteners for connection to the suit.

6. A system as claimed in claim 3 wherein said suit support means comprises loops for encircling the arms of the suit.

7. A system as claimed in claim 2 wherein said glove and boot supporting means include air inlets for filling with air the gloves and boots supported thereby.

8. A system as claimed in claim 7 wherein said boot supporting means includes support clips for supporting a portion of the boot.

9. A chemical decontamination monitoring system comprising:

a decontamination chamber which is shaped to provide drainage thereof and which includes a door opening and a pneumaticlly sealed door for providing access to the chamber, said door extending a substantially extent beyond the door opening around the entire periphery thereof, there being at least one seal on the door and on the adjacent chamber wall for providing sealing of said decontamination chamber;

a means for supporting protective clothing suspected of contamination within said chamber;

a plurality of spray nozzles equally spaced around said decontamination chamber at upper, intermediate and lower locations;

a reservoir for solvent located at the top of said decontamintion chamber;

a recirculation pump for pumping used solvent at the bottom of said decontamination chamber into said reservoir;

valve means for withdrawing used solvent spray from said decontamination chamber;

liquid chromatographic means for analyzing said used solvent spray to determine the contaminant content thereof a fan for directing air over said protective clothing;

mean for heating the air;

an outside air inlet with filters thereover for preventing migration of toxic effluents from said decontamination chamber to the external atmosphere;

means for withdrawing air from said decontamination chamber fter the air has passed over said protective clothing;

means for analyzing the air withdrawn from said chamber to determine the contaminate content thereof; and two paths as part of said air analyzing means, one of said path including a fluid collection reservoir and gas chromatographic means.

10. A system as claimed in claim 3 wherein said glove and boot supporting means include air inlets for filling with air the gloves and boots supported thereby.

11. A system as claimed in claim 10 wherein said boot supporting means includes support clips for supporting a portion of the boot.

* * * * *